US006265677B1

(12) United States Patent
Chao

(10) Patent No.: US 6,265,677 B1
(45) Date of Patent: Jul. 24, 2001

(54) KEYBOARD ASSEMBLY INCLUDING CIRCUIT MEMBRANE SWITCH ARRAY

(75) Inventor: Shih-Hung Chao, Taipei Hsien (TW)

(73) Assignee: Acer Peripherals, Inc., Taoyuan (TW)

( * ) Notice: Subject to any disclaimer, the term of this patent is extended or adjusted under 35 U.S.C. 154(b) by 0 days.

(21) Appl. No.: 09/348,125

(22) Filed: Jul. 2, 1999

(30) Foreign Application Priority Data

Jul. 7, 1998 (TW) ..... 87210918

(51) Int. Cl.[7] ..... H01H 13/70
(52) U.S. Cl. ..... 200/5 A; 200/517; 200/341
(58) Field of Search ..... 200/5 A, 5 R, 200/341–345, 512–517, 292

(56) References Cited

U.S. PATENT DOCUMENTS

| | | | | |
|---|---|---|---|---|
| 3,890,480 | | 6/1975 | Berling et al. | 200/302.2 |
| 3,917,917 | * | 11/1975 | Murata | 200/5 A |
| 4,225,970 | | 9/1980 | Jaramillo et al. | 455/575 |
| 4,363,942 | * | 12/1982 | Deeg et al. | 200/5 A |
| 4,366,463 | | 12/1982 | Barker | 338/69 |
| 4,396,830 | | 8/1983 | Isozaki et al. | 235/145 |
| 4,421,966 | | 12/1983 | Pounds | 200/309 |
| 4,580,018 | * | 4/1986 | Yoshihara | 200/5 A |
| 4,605,828 | * | 8/1986 | Gostomski, Jr. et al. | 200/5 A |
| 5,061,094 | * | 10/1991 | Buttner et al. | 200/512 X |
| 5,111,364 | | 5/1992 | Yoshimoto et al. | 361/757 |
| 5,114,790 | | 5/1992 | Corbett | 200/5 A X |
| 5,172,805 | * | 12/1992 | Gumb | 200/341 |
| 5,180,237 | | 1/1993 | Chen | 400/479 |
| 5,203,448 | * | 4/1993 | Osada et al. | 200/517 |
| 5,612,692 | | 3/1997 | Dugas et al. | 341/22 |
| 5,697,718 | | 12/1997 | Erler et al. | 400/495 |
| 5,810,491 | | 9/1998 | Muller et al. | 400/496 |

FOREIGN PATENT DOCUMENTS 3808567 9/1989 (DE) .

* cited by examiner

*Primary Examiner*—J. R. Scott
(74) *Attorney, Agent, or Firm*—Ladas & Parry

(57) ABSTRACT

The present invention provides a keyboard assembly, which comprises a plurality of key caps; a keyboard hood provided with a plurality of through holes for allowing the key caps to be insert thereinto, and a plurality of protrusions being formed on the top rim of each through hole; a plurality of dome-shaped elastic components disposed within the through holes of the keyboard hood, each dome-shaped elastic component having an upper rim and a bottom, the protrusions formed on the top rim of each through hole being higher than the upper rim of the dome-shaped elastic components disposed within the through holes; a circuit membrane disposed in a manner that it contacts with the upper rims of the dome-shaped elastic components; and a keyboard base fastened to the keyboard hood so as to enclose the end portions of the key caps, the dome-shaped elastic components, the circuit membrane, and the plate therebetween. As the protrusions formed on the top rim of each through hole are higher than the upper rim of the dome-shaped elastic components disposed within the through holes, the dome-shaped components can be received in the through holes without being hit by a wiper sweeping over the through holes.

11 Claims, 13 Drawing Sheets

KEYBOARD ASSEMBLY INCLUDING CIRCUIT MEMBRANE SWITCH ARRAY

FIELD OF THE INVENTION

The present invention relates to the structure of a keyboard. More particularly, it relates to the structure of a keyboard assembly capable of being assembled in an efficient way.

DESCRIPTION OF THE PRIOR ART

FIG. 1 is an exploded perspective view showing the structure of a conventional keyboard assembly 1. As shown in FIG. 1, the keyboard assembly 1 is composed of a keyboard hood 10, a plurality of key caps 11, a plurality of dome-shaped elastic components 13, a circuit membrane 14, a metal plate 15 and a keyboard base 12. The keyboard hood 10 is of a rectangular shape and is provided with a first surface 101 and a second surface 102. Furthermore, the keyboard hood 10 is provided with a plurality of through holes 100 for accommodating the cylindrical end portions 110 of the key caps 11. The key caps 11 are inserted into the through holes 100 in the direction from the first surface 101 toward the second surface 102 of the keyboard hood 10. The circuit membrane 14 and the metal plate 15 are affixed on the keyboard hood 10 by a plurality of screws 16 with the dome-shaped elastic components 13 disposed therebetween, and the keyboard hood 10 is connected to the keyboard base 12 by a plurality of screws 17.

FIG. 2A is an exploded perspective view showing the structures of the dome-shaped elastic component 13, the through hole 100 of the keyboard hood 10, the key cap 11, the circuit membrane 14 and the metal plate 15. The openings 103, 104 of the through hole 100 are formed respectively on the first surface 101 and the second surface 102 of the keyboard hood 10. A circular rim 105 is formed around the opening 104 of the through hole 100.

FIG. 2B is an exploded perspective view showing the state in which the elastic component 13 and the key cap 11 are assembled together with the keyboard hood 10. As shown in FIG. 2B, the end portion 130 of the elastic component 13 is in contact the cylindrical end portion 110 of the key cap 11.

FIG. 3 is a cross-sectional view showing a wiper being used to feed elastic components into the through holes formed on the keyboard hood. As shown in FIG. 3, a wiper 5 is used to urge dome-shaped components 13 to enter the through holes 100. The wiper 5 is in the form of an elastic blade, which is used to sweep over the top end portion 106 of the circular rim 105 of the through holes 100.

During operation, the dome-shaped components 13 are scattered on the second surface 102 and incidentally some of them are disposed within the through holes 100. As shown in FIG. 3, the top surface of the upper rim 131 of the elastic component 13 disposed within the through holes 100 is higher than the circular rim 105 formed on the second surface 102 of the keyboard hood 10 by an elevation difference $H^+$. Therefore, it stands a chance that the dome-shaped components 13 disposed within the through holes 100 might bound out of the through holes 100 when the wiper 5 urges the upper rims 131 of the dome-shaped components 13 during the sweeping of the wiper 5 over the through holes 100. If there still exists an empty through hole 100 that is not filled with a dome-shaped component 23, then the wiper 5 has to sweep once again. Hence, the total process is inefficient.

SUMMARY OF THE INVENTION

Therefore, the object of this invention to provide means for preventing the dome-shaped components from bounding out of the through holes while the wiper sweeps over the through holes.

To achieve the above object, the keyboard assembly of this invention comprises a plurality of key caps, each of which having an end portion; a keyboard hood provided with a plurality of through holes, each through hole having a first opening and a second opening, the end portions of the key caps being inserted into the first opening, and a top rim being formed on the brim of each second opening and a plurality of protrusions being formed on the top rim of each through hole; a plurality of dome-shaped elastic components disposed within the through holes of the keyboard hood so as to allow their bottoms to be urged by the end portions of the key caps, each dome-shaped elastic component having an upper rim and a bottom, the protrusions formed on the top rim of each through hole being higher than the upper rim of the dome-shaped elastic components disposed within the through holes; a circuit membrane disposed in a manner that it contacts with the upper rims of the dome-shaped elastic components; and a keyboard base fastened to the keyboard hood so as to enclose the end portions of the key caps, the dome-shaped elastic components, the circuit membrane, and the plate therebetween.

Furthermore, the protrusions formed on the top rim of each through hole are spaced apart from each other.

Furthermore, the circuit membrane is provided with a plurality of punched holes formed therein, and each punched hole is located at a site corresponding to a protrusion so as to allow the protrusions to penetrate therethrough.

Furthermore, in the above keyboard assembly, a metal plate is additionally disposed between the keyboard base and the circuit membrane, the metal plate being provided with a plurality of punched holes, each of which is located at a site corresponding to a protrusion so as to allow the protrusions to penetrate therethrough.

Furthermore, the keyboard base is provided with a plurality of recesses, each of which is located at a site corresponding to a protrusion so as to allow the protrusions to insert therein.

As the protrusions formed on the top rim of each through hole is higher than the upper rim of the dome-shaped elastic components disposed within the through holes, the dome-shaped components can be received in the through holes without being hit by the wiper sweeping over the through holes.

BRIEF DESCRIPTION OF THE DRAWINGS

The present invention can be more fully understood from the following detailed description and preferred embodiments with reference to the accompanying drawings in which.

PREFERRED EMBODIMENTS OF THE INVENTION

Figure 1:
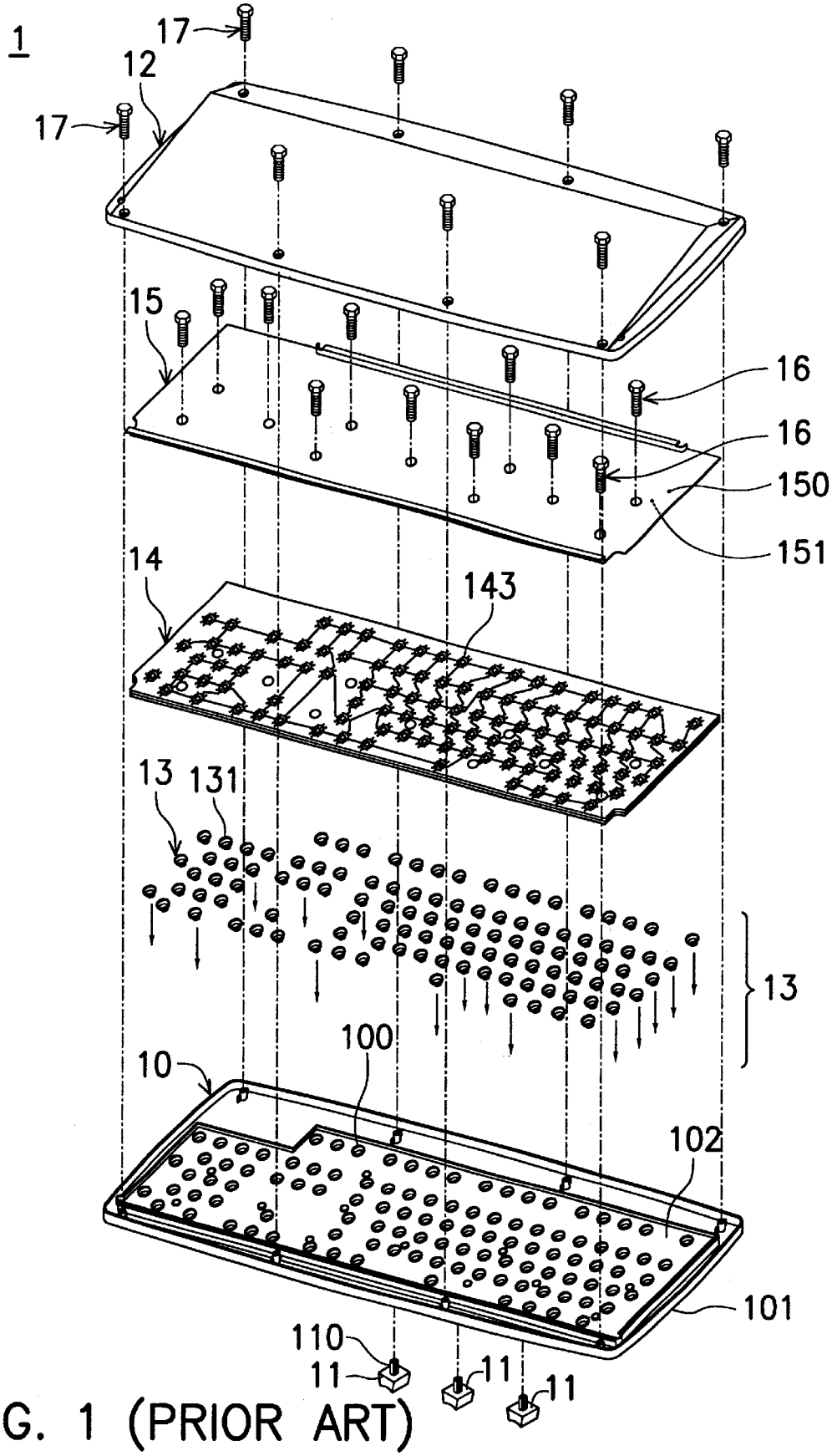
FIG. 1 (PRIOR ART)
FIG. 1 is an exploded perspective view showing the structure of a conventional keyboard assembly.
Figure 2A:
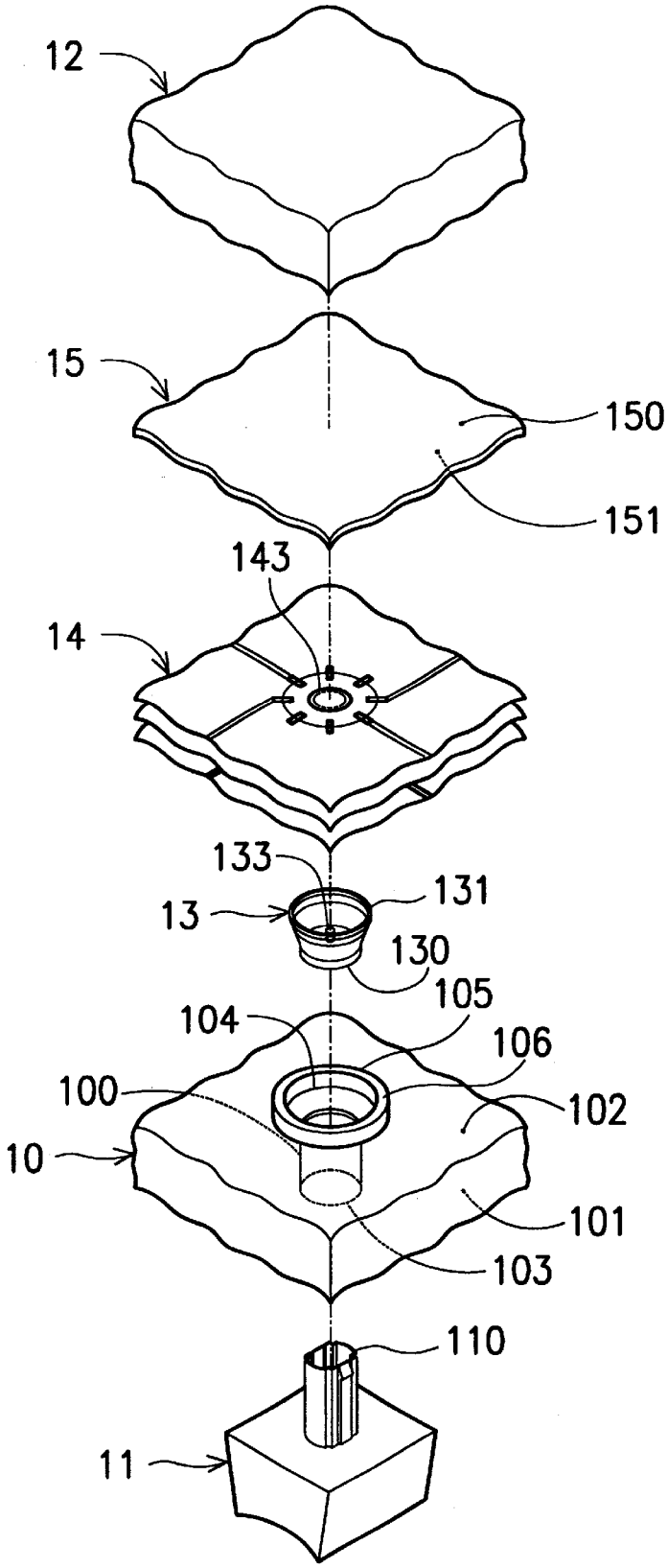
FIG. 2A (PRIOR ART)
FIG. 2A is an enlarged exploded perspective view showing the structures of the dome-shaped elastic component, the through hole of the keyboard hood, the key cap, the circuit membrane, and the metal plate shown in FIG. 1.
Figure 2B:
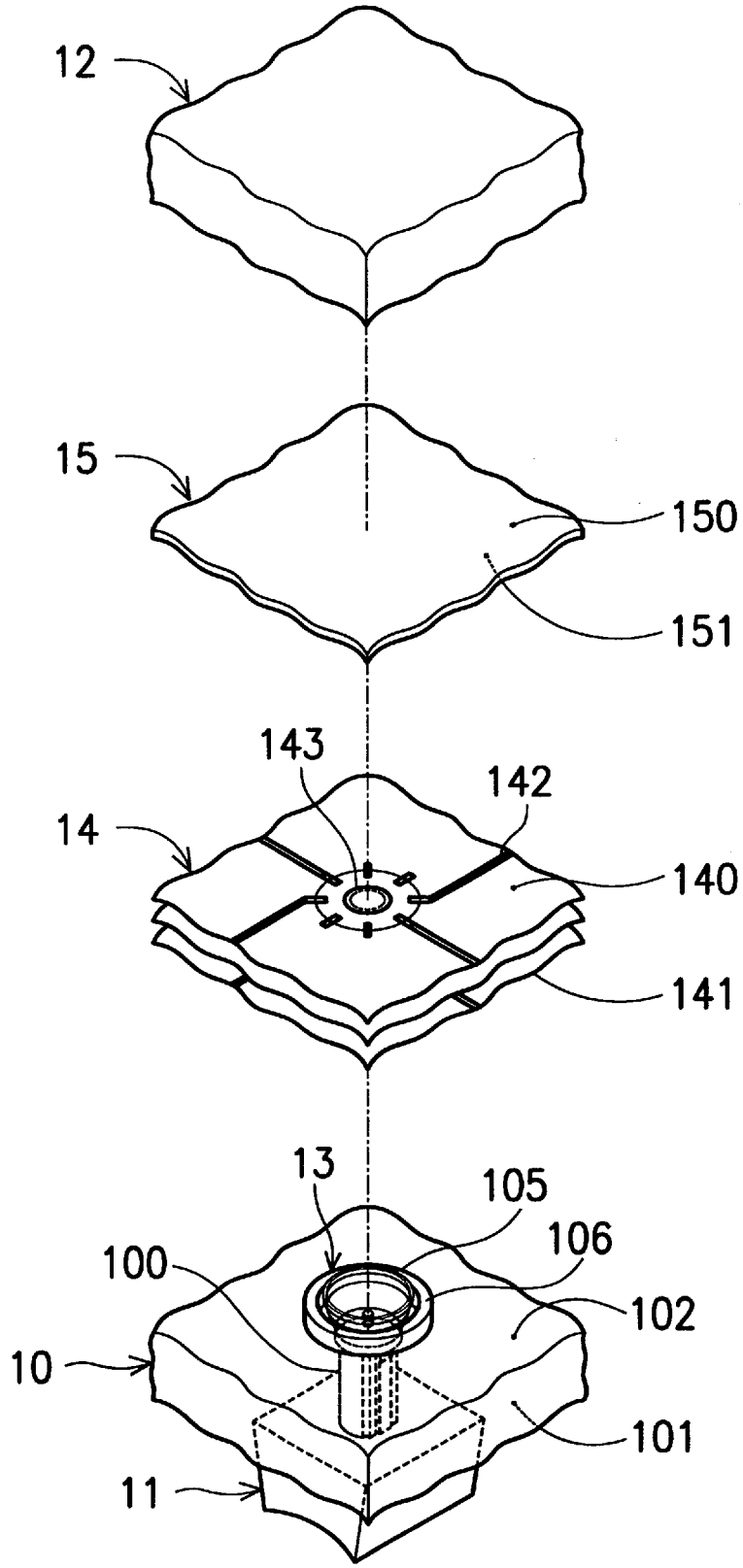
FIG. 2B (PRIOR ART)
FIG. 2B is an exploded perspective view showing the state in which the dome-shaped elastic component and the key cap are assembled together with the keyboard hood.
Figure 3:
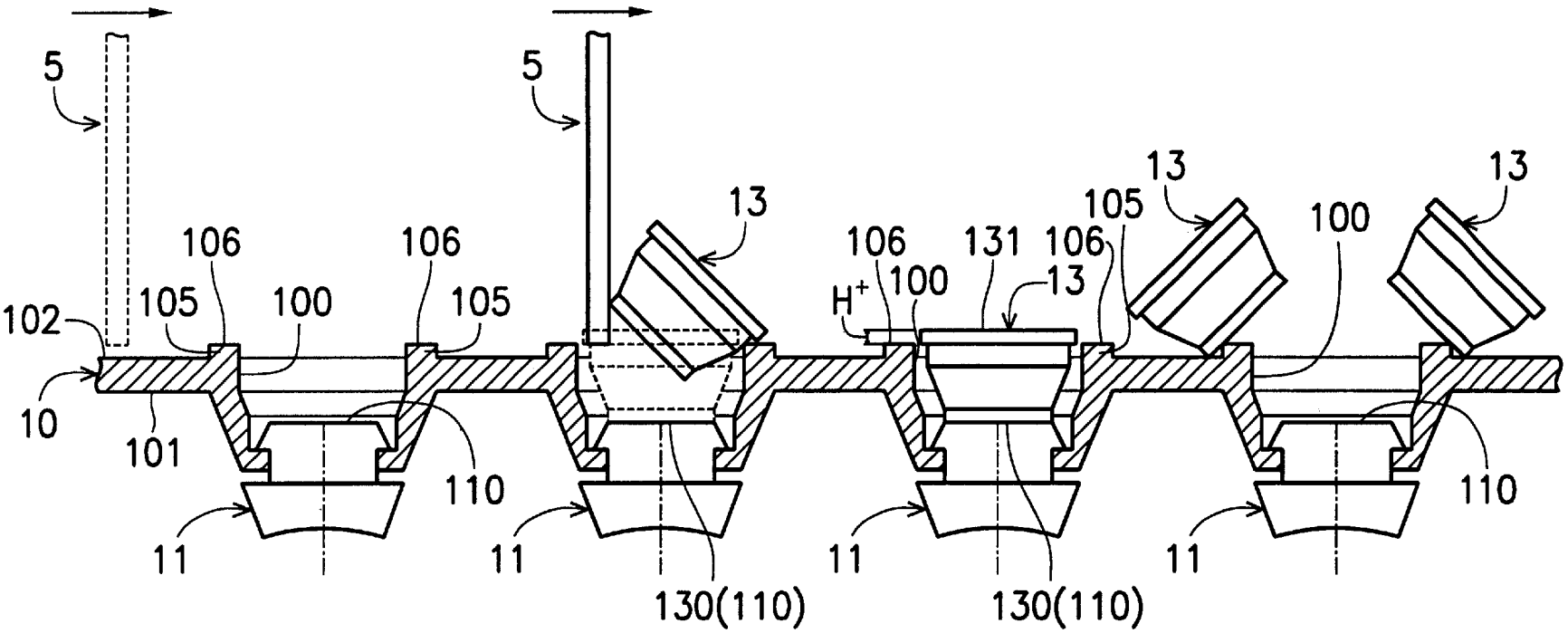
FIG. 3 (PRIOR ART)
FIG. 3 is a cross-sectional view showing a wiper being used to feed dome-shaped elastic components into the through holes formed on the keyboard hood shown in FIG. 1.
Figure 4:
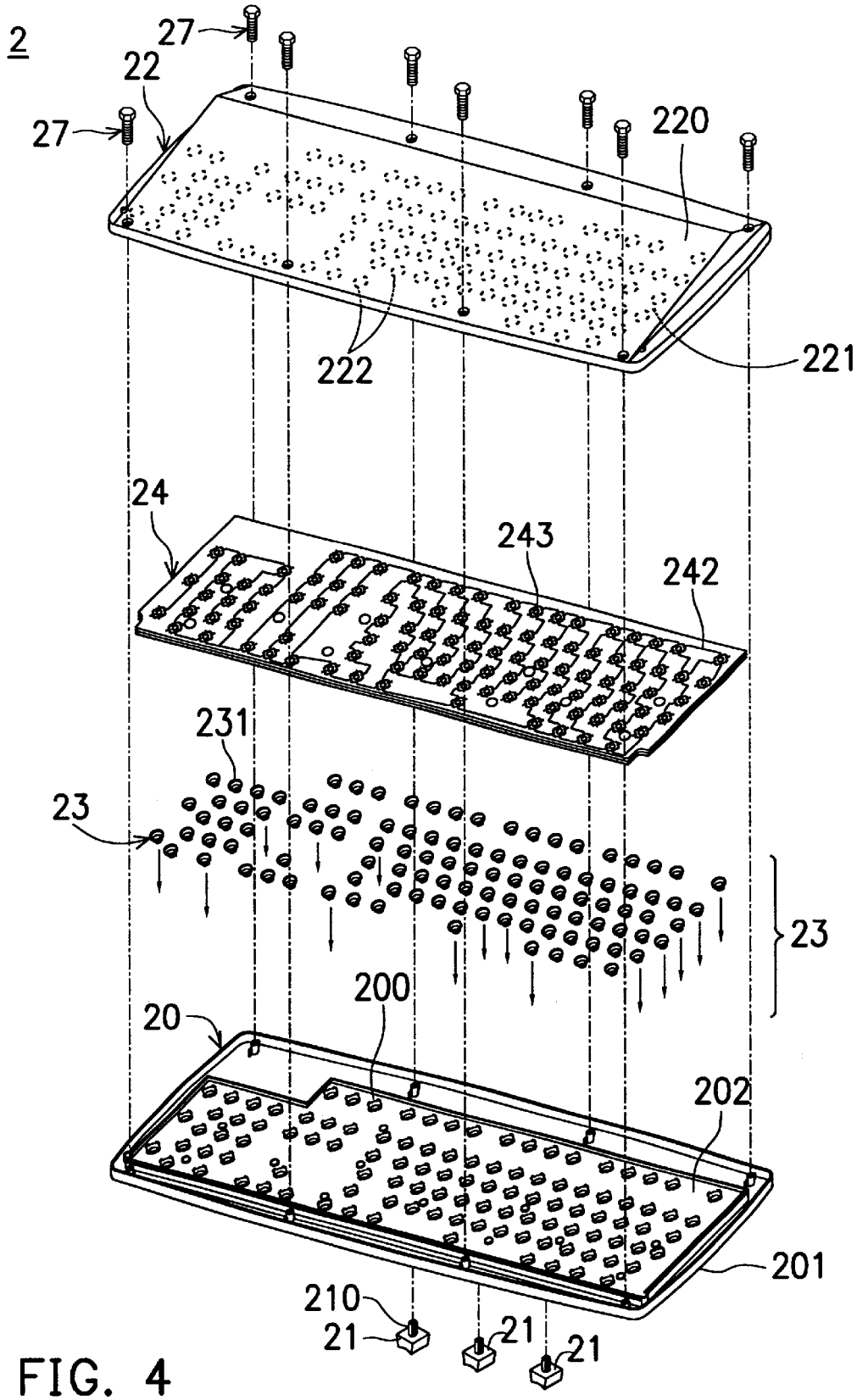
FIG. 4 is an exploded perspective view showing the first preferred embodiment of a keyboard assembly according to this invention.
Figure 5:
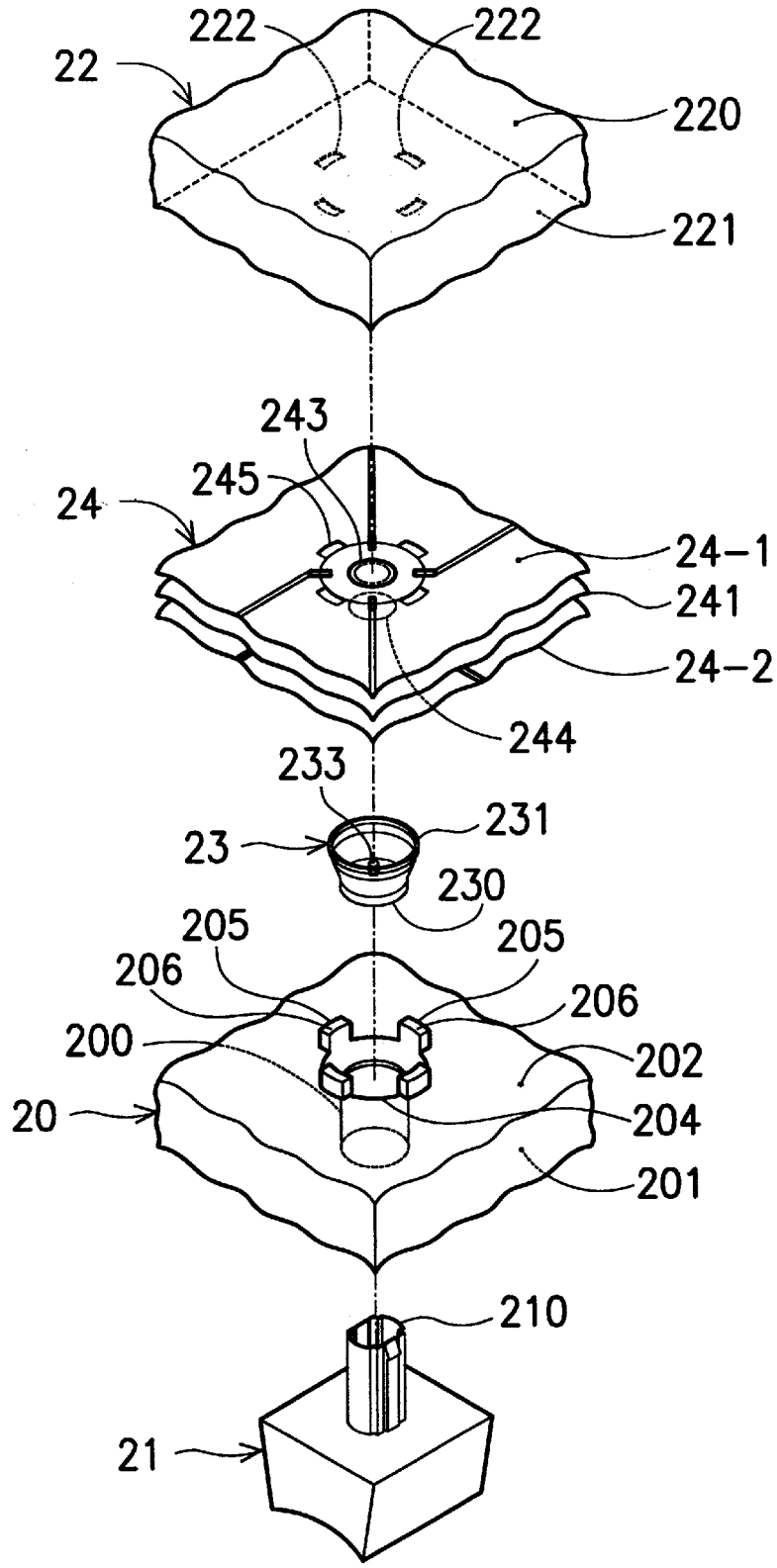
FIG. 5 is an enlarged exploded perspective view showing the structures of the dome-shaped elastic component, the through hole of the keyboard hood, the key cap, and the circuit membrane shown in FIG. 4.

FIG. 4 is an exploded perspective view showing the first preferred embodiment of a keyboard assembly according to this invention. FIG. 5 is an enlarged exploded perspective view showing the structures of the dome-shaped elastic component 23, the through hole 200 of the keyboard hood 20, the key cap 21, and the circuit membrane 24 shown in FIG. 4. As shown in FIGS. 4 and 5, the keyboard assembly 2 is composed of a keyboard hood 20, a plurality of key caps 21, a keyboard base 22, a plurality of dome-shaped elastic components 23, and a circuit membrane 24. The keyboard hood 20 is of a rectangular shape and is provided with a first surface 201 and a second surface 202. The keyboard hood 20 is also provided with a plurality of through holes 200 for accommodating the cylindrical end portions 210 of the key caps 21, which are inserted from the first surface 201 toward the second surface 202 of the keyboard hood 20. The dome-shaped elastic components 23 are disposed between the circuit membrane 24 and the keyboard hood 20, which is connected to the keyboard base 22 by a plurality of screws 27. Four protrusions 205 are formed on the opening rim 204 of each through hole 200 in an equally spaced manner. Each dome-shaped elastic component 23 has an upper rim 231 and a bottom 230. It is arranged that the protrusions 205 formed on the rim 204 of each through hole 200 is higher than the upper rims 231 of the dome-shaped elastic components 23 received within the through holes 200. As shown in FIG. 5, a cylindrical post 233 is formed on the central portion of the dome-shaped elastic component 23. The circuit membrane 24 is composed of a first circuit sheet 24-1, a second circuit sheet 24-2, and an intermediate sheet 241. The intermediate sheet 241 is disposed between the first circuit sheet 24-1 and the second circuit sheet 24-2, and a couple of conductive pads 243, 244 are respectively formed on the first circuit sheet 24-1 and the second circuit sheet 24-2. The conductive pads 243 and 244 are spaced apart and facing each other with the intermediate sheet 241 disposed therebetween. When the conductive pads 243, 244 are urged to contact each other, the circuit 242 formed on the circuit membrane 24 can detect the pushing of the key cap 21. The post 233 urges the conductive pad 244 to contact the conductive pad 243 when the key cap 21 is pushed down, and the pushing of the key cap 21 is detected.

Figure 6A:
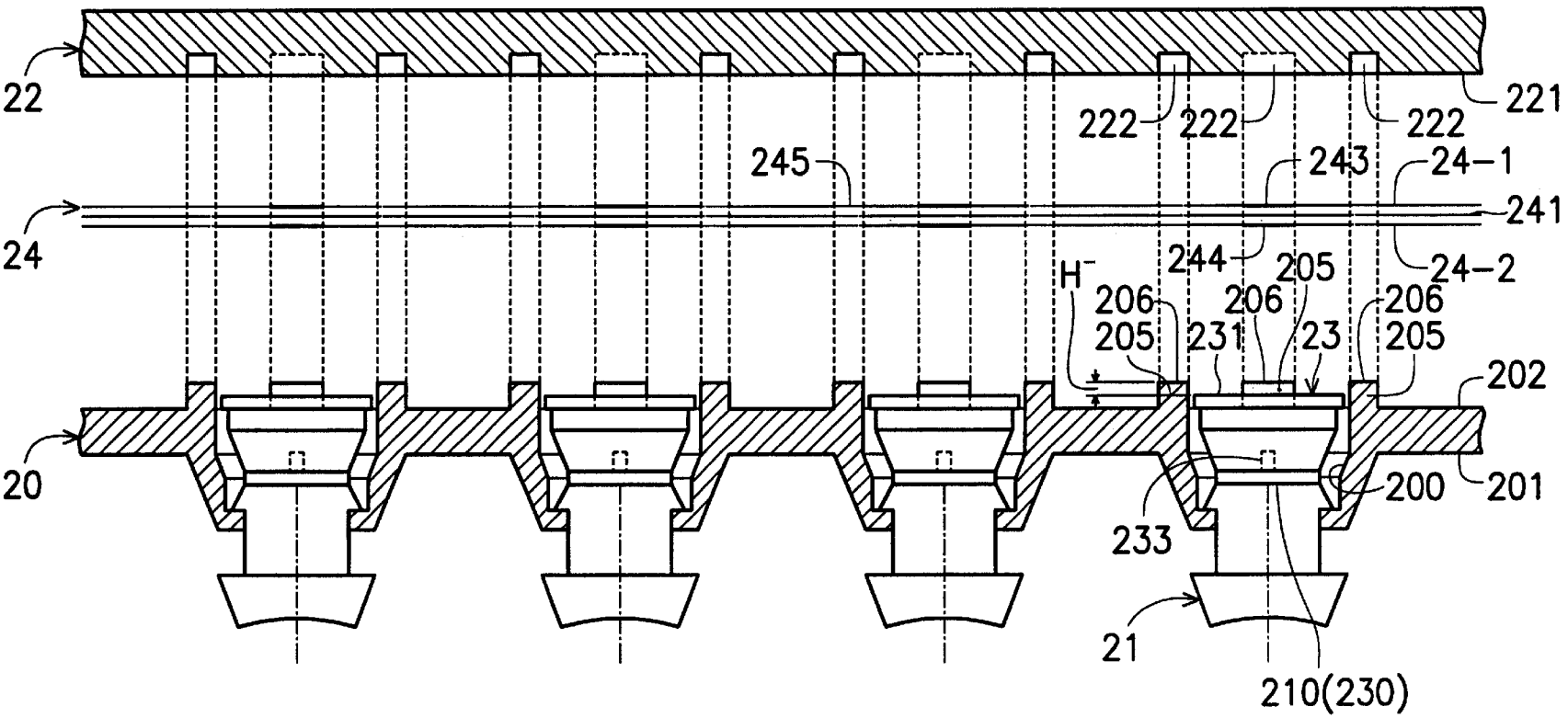
FIG. 6A is a cross-sectional view showing the dome-shaped elastic components received in the keyboard hood before fabricating the keyboard assembly.
Figure 6B:
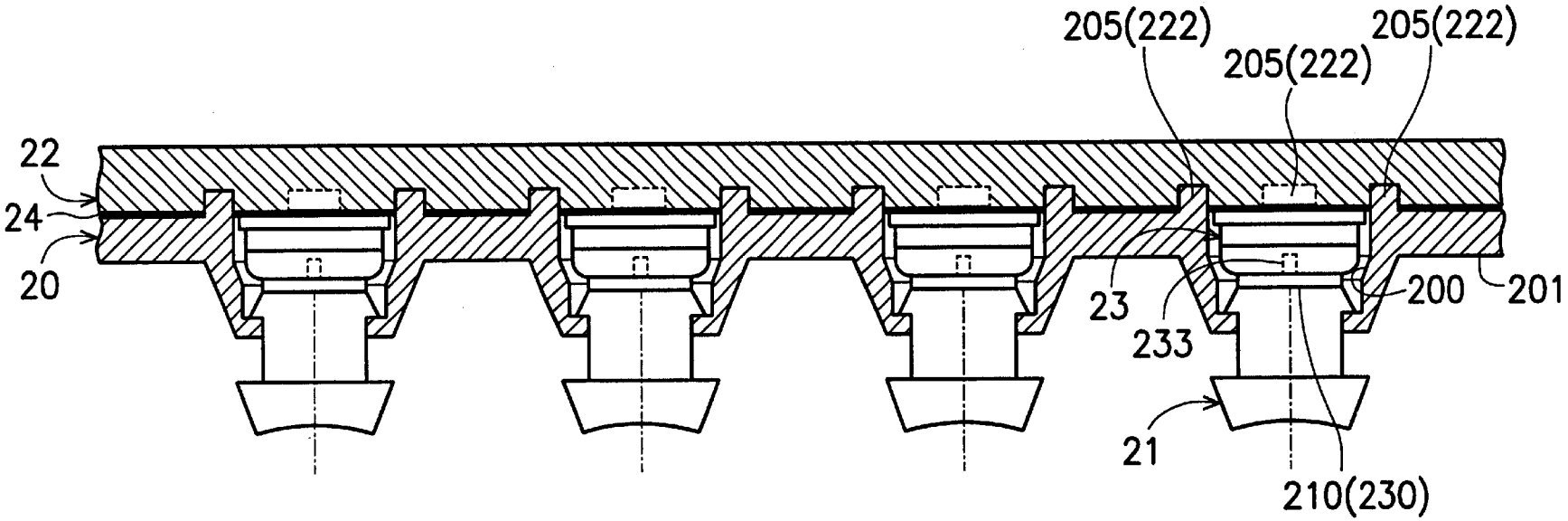
FIG. 6B is a cross-sectional view showing the fabricated state of the keyboard assembly shown in FIG. 6A.

The circuit membrane 24 is provided with four punched holes 245 whose locations correspond to those of the protrusions 205. Four recesses 222 are formed on the keyboard base 22. The locations of the recesses 222 are also respectively corresponding to those of the protrusions 205. As shown in FIGS. 6A and 6B, the key caps 21 are inserted into the through holes 200 and engaged therein. The bottom 230 of each of the dome-shaped components 23 is in contact the cylindrical end portion 210 of each key cap 21, and the upper rim 231 of each of the elastic components 23 is in contact the circuit membrane 24.

When the keyboard hood 20 is engaged with the keyboard base 22 (see FIG. 6B), the protrusions 205 penetrate the punched holes 245 and enter the recesses 222 formed in the keyboard base 22. The dome-shaped components 23 are restrained between the key caps 21 and the keyboard base 22, and the upper rims 231 of the dome-shaped components 23 are urged to contact the second circuit sheet 24-2 of the circuit membrane 24. Because the protrusions 205 play the role of positioning, the keyboard assembly 2 can be fabricated with high accuracy.

Figure 7:
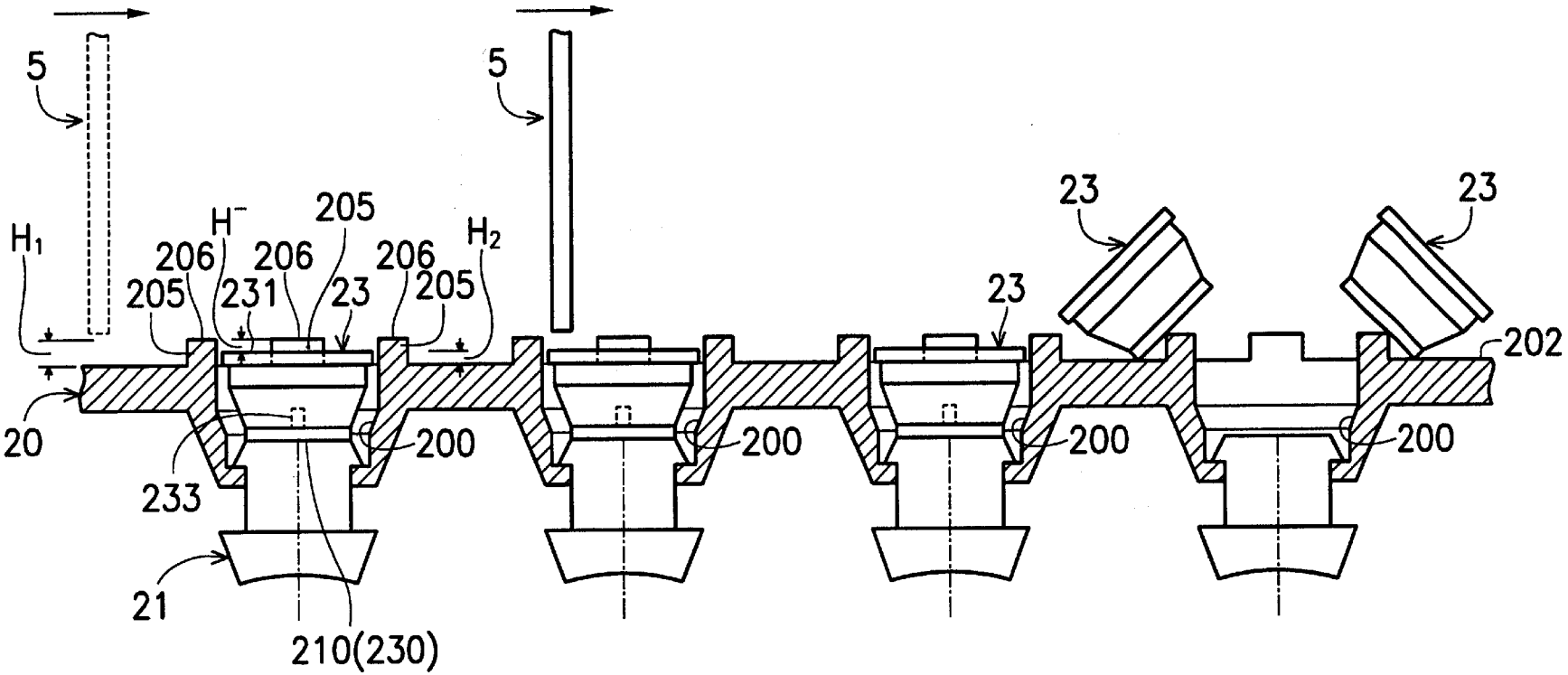
FIG. 7 is a cross-sectional view showing a wiper being used to feed dome-shaped elastic components into the through holes formed on the keyboard hood shown in FIG. 4.

FIG. 7 is a cross-sectional view showing a wiper being used to feed dome-shaped elastic components into the through holes formed on the keyboard hood. A wiper 5 made of elastic material sweeps over the protrusions 205 so as to feed dome-shaped components 23 into the through holes 200. The upper rims 231 of the dome-shaped components 23 properly fed into the through holes 200 are below the top surfaces 206 of the protrusions 205 by an elevation difference $H^-$. Therefore, the wiper 5 will not touch the dome-shaped components 23 properly disposed within the through holes 200 when it sweeps over the dome-shaped components 23. This enables the fabrication of the keyboard assembly to be performed in an efficient way.

Figure 8:
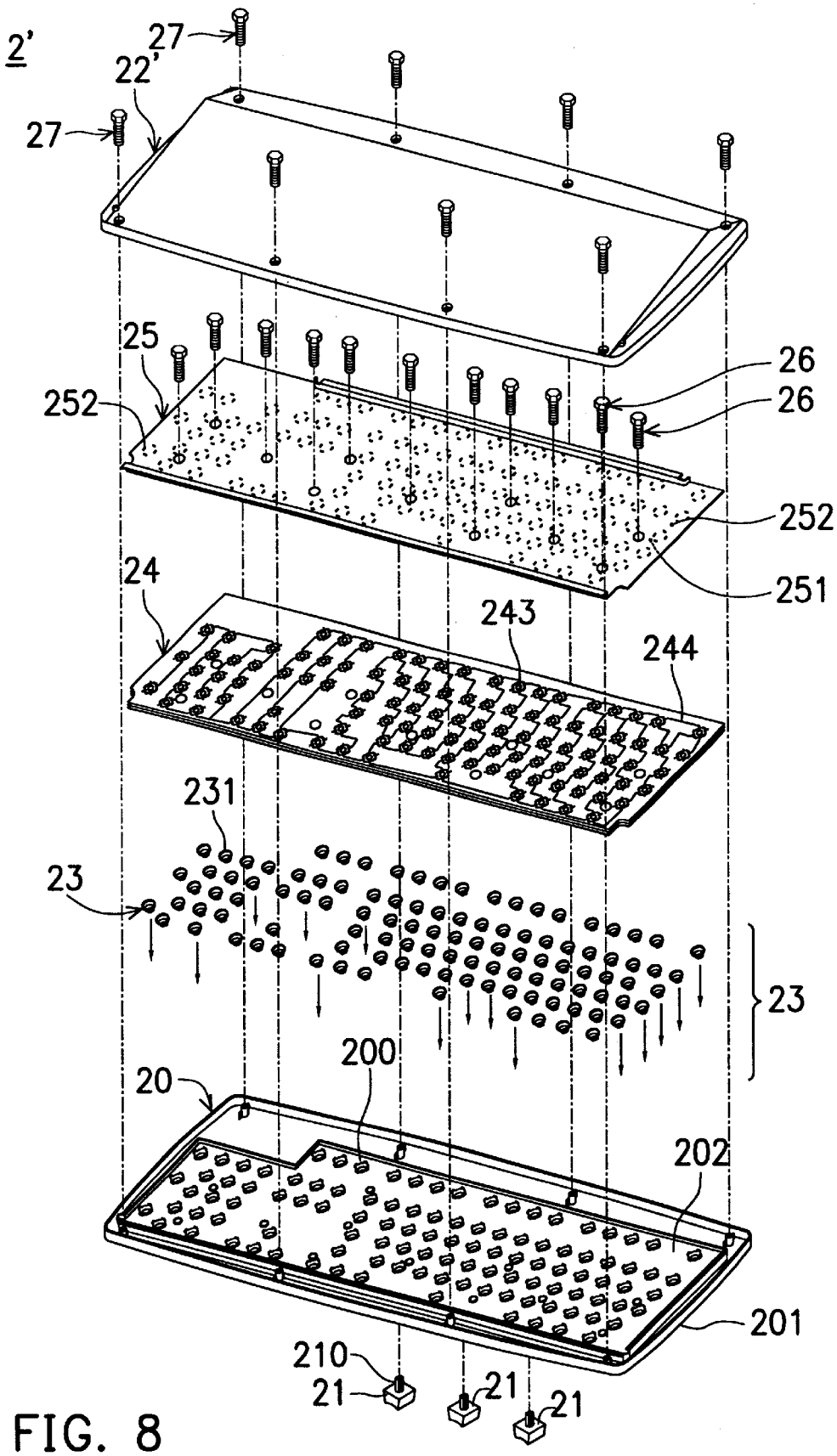
FIG. 8 is an exploded perspective view showing the second preferred embodiment of a keyboard assembly according to this invention.
Figure 9:
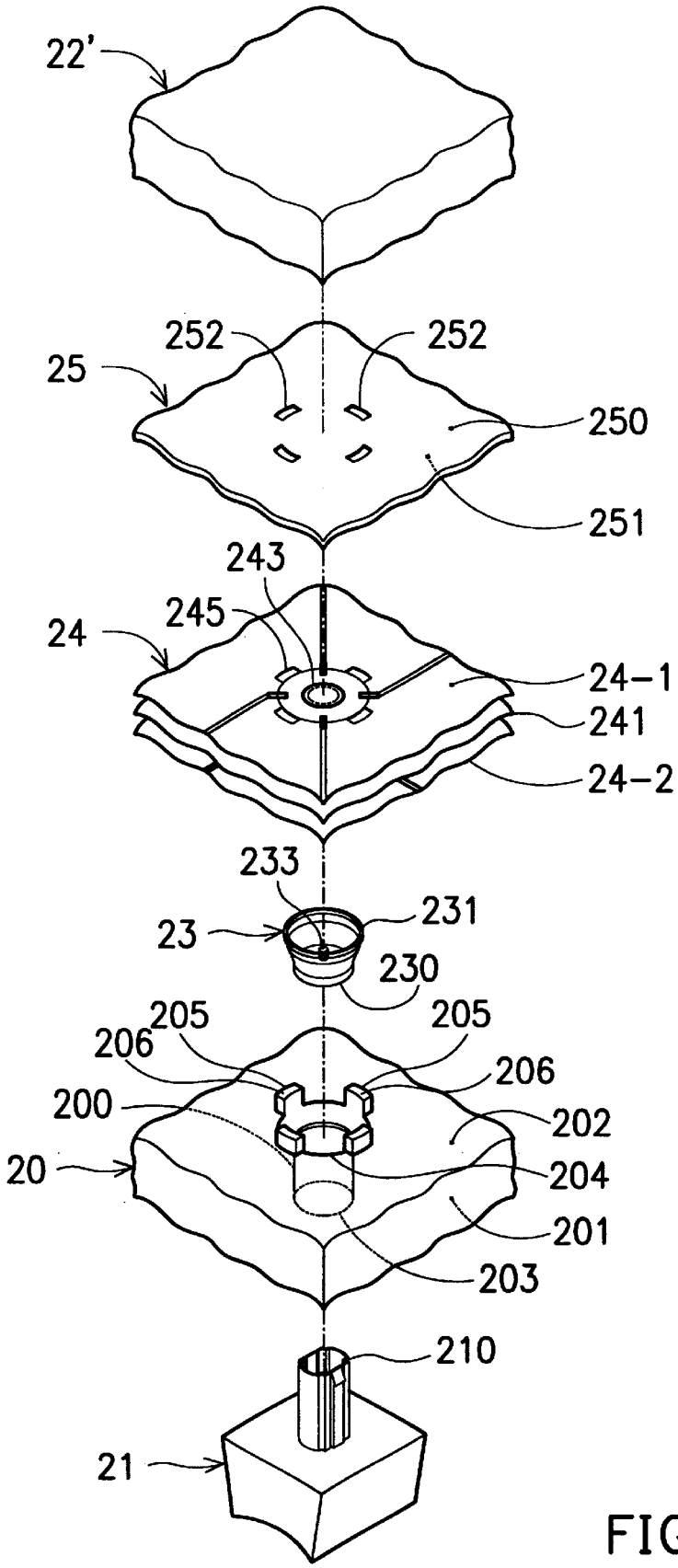
FIG. 9 is an enlarged exploded perspective view showing the structures of the dome-shaped elastic component, the through hole of the keyboard hood, the key cap, the circuit membrane, and the metal plate shown in FIG. 8.
Figure 10A:
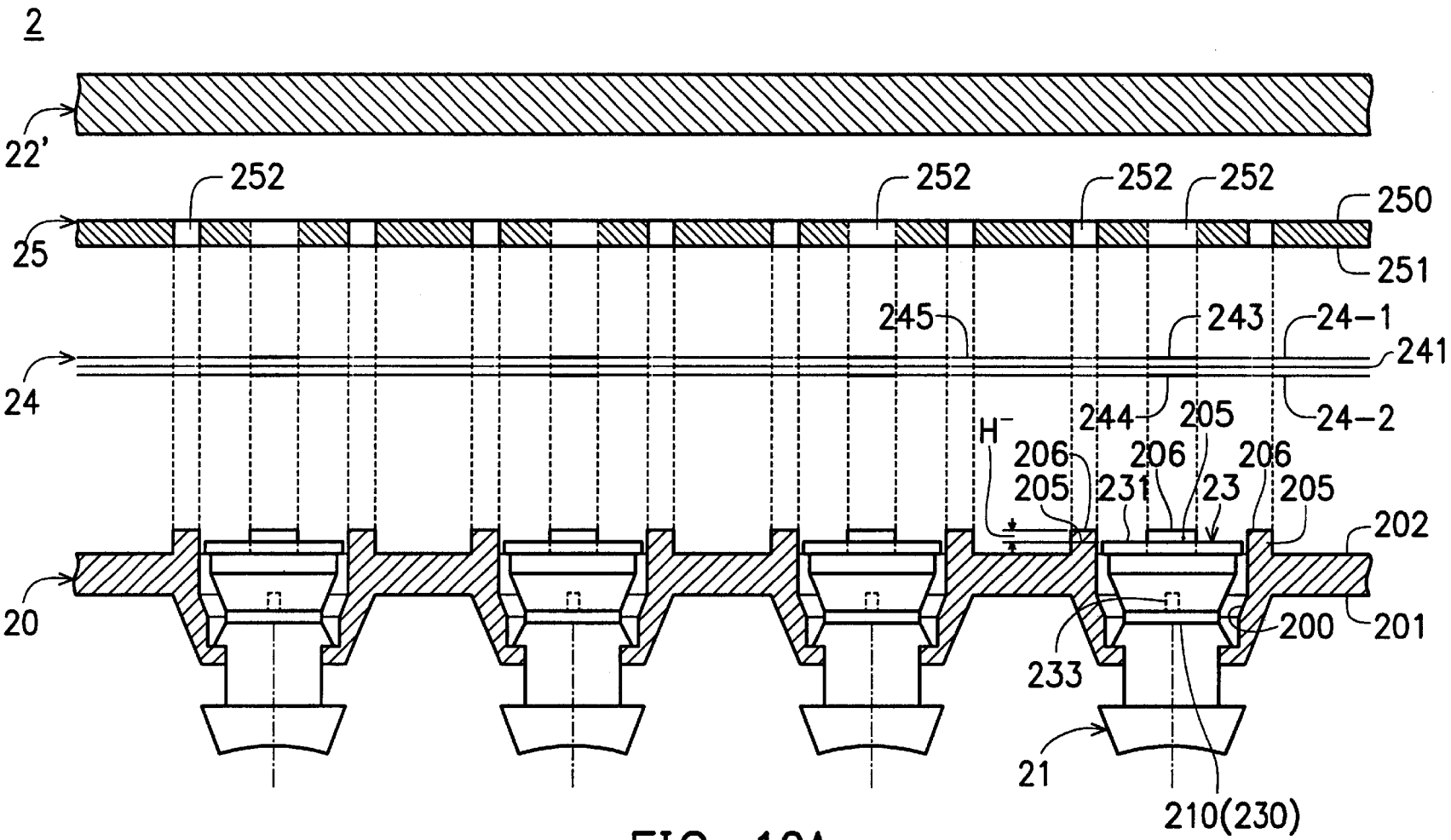
FIG. 10A is a cross-sectional view showing the dome-shaped elastic components received in the keyboard hood before fabricating the keyboard assembly.

FIG. 8 is an exploded perspective view showing the second preferred embodiment of a keyboard assembly according to this invention. As shown in FIG. 8, in the second preferred embodiment, a metal plate 25 is additionally disposed between the keyboard base 22' and the circuit membrane 24. The keyboard base 22' is engaged with the keyboard hood 20 by means of the screws 26. FIG. 9 is an enlarged exploded perspective view showing the structures of the dome-shaped elastic component 23, the through hole of the keyboard hood 20, the key cap 21, the circuit membrane 24, and the metal plate 25. FIG. 10A is a cross-sectional view showing the dome-shaped elastic components received in the keyboard hood before fabricating the keyboard assembly. As shown in FIG. 9 and FIG. 10A, the metal plate 25 has four punched holes 252 whose locations correspond to those of the protrusions 205.

Figure 10B:
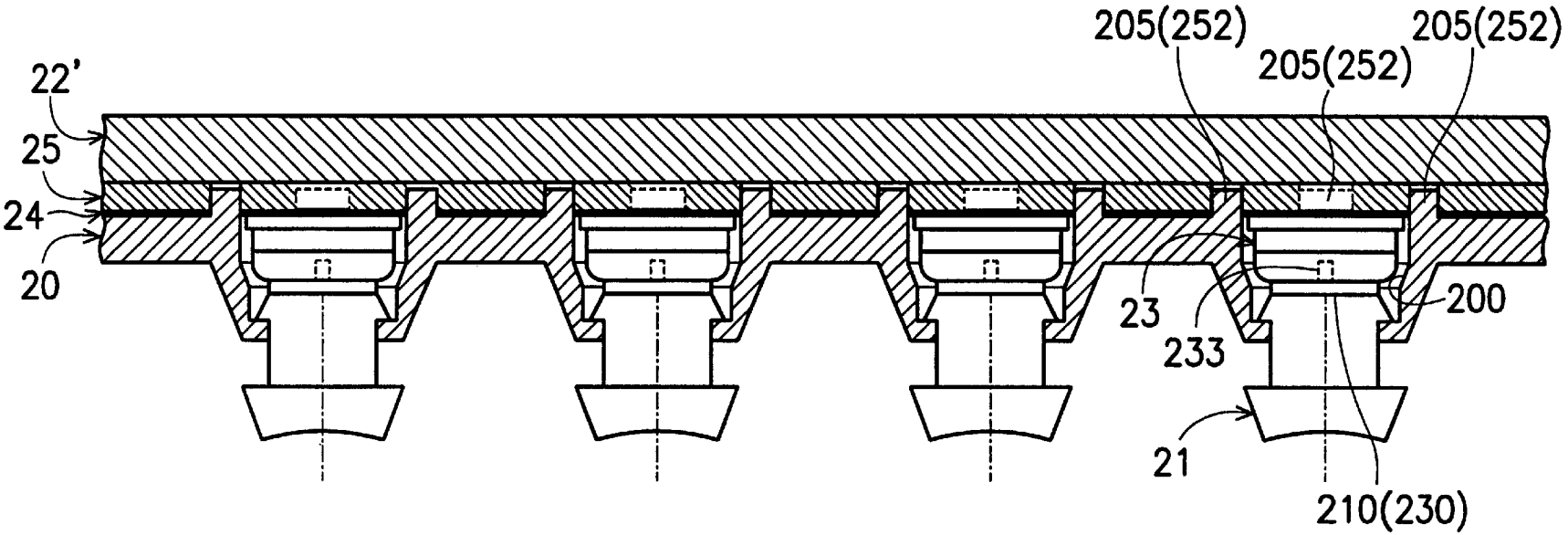
FIG. 10B is a cross-sectional view showing the fabricated state of the keyboard assembly shown in FIG. 10A.

FIG. 10B is a cross-sectional view showing the fabricated state of the keyboard assembly 2'. As shown in FIG. 10B, the dome-shaped components 23 are urged by the metal plate 25 and the key cap 21 when the dome-shaped components 23 are disposed in the through holes 200 of the keyboard hood 20. The protrusions 205 penetrate the circuit membrane 24 and enter the holes 252 formed in the metal plate 25.

Because the protrusions 205 in this embodiment also play the role of positioning, the keyboard assembly 2 can be fabricated with high accuracy.

Similarly, pushing the key cap 21 will deform the dome-shaped component 23 and the post 233 of the dome-shaped component 23 will urge the conductive pad 244 to contact the conductive pad 243. If the conductive pad 244 touches the conductive pad 243, the circuit 242 formed on the circuit membrane 24 will detect the pushing of the key cap 21.

Because the metal plate 25 contacts with the circuit membrane 24 tightly, the circuit membrane 24 has a stiffer resistance to the bending incurred by the pushing of the key caps 21.

What is claimed is:

1. A keyboard assembly comprising:

a plurality of key caps, each of which having an end portion;

a keyboard hood provided with a plurality of through holes, each through hole having a first opening and a second opening, the end portions of the key caps being inserted into the first opening, and a top rim being formed on the brim of each second opening and a plurality of protrusions being formed on the top rim of each through hole;

a plurality of dome-shaped elastic components disposed within the through holes of the keyboard hood, each of the dome-shaped elastic components having an upper rim and a bottom so as to allow their bottoms to be urged by the end portions of the key caps, the protrusions formed on the top rim of each through hole being higher than the upper rim of the dome-shaped elastic components disposed within the through holes;

a circuit membrane disposed in a manner that it contacts with the upper rims of the dome-shaped elastic components; and a keyboard base fastened to the keyboard hood so as to enclose the end portions of the key caps, the dome-shaped elastic components, and the circuit membrane therebetween.

2. A keyboard assembly as claimed in claim 1, wherein the protrusions formed on the top rim of each through hole are spaced apart from each other.

3. A keyboard assembly as claimed in claim 2, wherein the circuit membrane is provided with a plurality of punched holes formed therein, and each punched hole is located at a site corresponding to each protrusion so as to allow the protrusions to penetrate therethrough.

4. A keyboard assembly as claimed in claim 3, wherein the keyboard base is provided with a plurality of recesses each of which is located at a site corresponding to each protrusion so as to allow the protrusions to insert therein.

5. A keyboard assembly as claimed in claim 4 further comprising a metal plate disposed between the keyboard base and the circuit membrane.

6. A keyboard assembly as claimed in claim 5, wherein each of the dome-shaped elastic components is made of rubber.

7. A keyboard assembly comprising:

a plurality of key caps, each of which having an end portion;

a keyboard hood provided with a plurality of through holes, each through hole having a first opening and a second opening, the end portions of the key caps being inserted into the first opening, and a top rim being formed on the brim of each second opening and a plurality of protrusions being formed on the top rim of each through hole;

a plurality of dome-shaped elastic components disposed within the through holes of the keyboard hood, each of the dome-shaped elastic components having an upper rim and a bottom so as to allow their bottoms to be urged by the end portions of the key caps, the protrusions formed on the top rim of each through hole being higher than the upper rim of the dome-shaped elastic components disposed within the through holes;

a circuit membrane disposed in a manner that it contacts with the upper rims of the dome-shaped elastic components;

a plate disposed on said circuit membrane and provided with a plurality of punched holes each of which is located at a site corresponding to each protrusion so as to allow the protrusions to penetrate therethrough; and a keyboard base fastened to the keyboard hood so as to enclose the end portions of the key caps, the dome-shaped elastic components, the circuit membrane, and the plate therebetween.

8. A keyboard assembly as claimed in claim 7, wherein the protrusions formed on the top rim of each through hole are spaced apart from each other.

9. A keyboard assembly as claimed in claim 8, wherein the circuit membrane is provided with a plurality of punched holes formed therein, and each punched hole is located at a site corresponding to each protrusion so as to allow the protrusions to penetrate therethrough.

10. A keyboard assembly as claimed in claim 9 further comprising a metal plate disposed between the keyboard base and the circuit membrane.

11. A keyboard assembly as claimed in claim 10, wherein each of the dome-shaped elastic components is made of rubber.

* * * * *